US008686654B2

(12) United States Patent
Hawley

(10) Patent No.: US 8,686,654 B2
(45) Date of Patent: Apr. 1, 2014

(54) EFFICIENCY REGULATION FOR LED ILLUMINATION

(75) Inventor: Stephen W. Hawley, Redwood City, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 144 days.

(21) Appl. No.: 13/325,707

(22) Filed: Dec. 14, 2011

(65) Prior Publication Data

US 2013/0154491 A1 Jun. 20, 2013

(51) Int. Cl.
*H05B 37/02* (2006.01)

(52) U.S. Cl.
USPC ..... 315/200 R; 315/217; 315/297; 315/307

(58) Field of Classification Search
USPC ..... 315/200 R, 224, 209 R, 210, 215, 217, 315/297, 307, 313
See application file for complete search history.

(56) References Cited

U.S. PATENT DOCUMENTS

| | | | | |
|---|---|---|---|---|
| 7,550,934 | B1 * | 6/2009 | Deng et al. | 315/308 |
| 2008/0224636 | A1 * | 9/2008 | Melanson | 315/307 |

* cited by examiner

*Primary Examiner* — Daniel D Chang
(74) *Attorney, Agent, or Firm* — North Weber & Baugh LLP

(57) ABSTRACT

Various embodiments of the present invention relate to a switch-mode regulator, and more particularly, to systems, devices and methods of using a switch-mode regulator to regulate an LED current to improve overall LED system efficacy and suppress power consumption of a dimmable LED illumination system. Both high and moderate brightness modes are implemented in an LED driver based on the switch-mode regulator. In the high brightness mode, the LED current is larger than a preferred LED current. In the moderate brightness mode, the LED current is smaller than the preferred LED current, and the LED driver sustains the preferred driver efficiency while the LED current remains as a direct current. Such a switch-mode power supply or regulator may also be used in applications other than the LED illumination system.

20 Claims, 6 Drawing Sheets

200

200

EFFICIENCY REGULATION FOR LED ILLUMINATION

BACKGROUND

A. Technical Field

The present invention relates to a switch-mode regulator, and more particularly, to systems, devices and methods of using a switch-mode regulator to regulate an LED current in order to improve overall system efficacy and suppress power consumption of a dimmable light emitting diode (hereinafter, "LED") illumination system. Such a switch-mode regulator may also be used in applications other than the LED illumination system.

B. Background of the Invention

Semiconductor-based solid-state lighting (SSL), until recently associated mainly with simple indicator lamps in electronics and toys, has become more common as SSL solutions continue to improve when compared to other lighting technologies. In particular, the enormous technology improvements have been achieved on light emitting diodes (LEDs) over the past years. LEDs have been available for various wavelengths, and suitable for white illumination. Lifetime of LEDs is also extended to more than 100 thousand hours, and can work up to many watts input power.

When compared to conventional lamps, LEDs are relatively smaller, require significant lower amount of power, and have a longer operating life. LEDs are normally connected in series as an LED string for use in lighting applications. Each power LED in the LED string used for illumination requires a nominal LED current in the range of 35-1400 mA, a forward voltage drop of 3V, and large manufacturing tolerances. The amount of power for LEDs to operate is much less than that of a typical halogen lamp. A halogen lamp may operate within a range of 20-50 Watts, while an LED at about 5-10 Watts is sufficient to provide a similar level of brightness. However, a need always exists to further enhance the energy efficiency of an LED illumination system.

FIG. 1A illustrates a standard LED illumination system 100 and power dissipation in such a system. The LED illumination system 100 comprises an LED driver 102 and an LED light module 104. The LED driver 102 is coupled to receive a DC supply voltage VSUP from a DC supply 106, and the voltage VSUP is further converted by the LED driver 102 to a drive voltage VT and an LED current 108. The LED light module 104 is driven by this drive voltage VT and the LED current 108. Illumination power $P_{LED}$, i.e., brightness, of the LED diodes in the module 104 is directly associated with the LED current 108 that passes through the LED diodes.

In the LED illumination system 100, an input power $P_{IN}$ provided by the supply 106 is not fully converted to the illumination power of the LED light module 104. Both the LED driver 102 and the LED light module 104 dissipate some energy in the format of heat and invisible radiation during their respective process for voltage conversion and LED illumination. In particular, the LED driver 102 is typically based on a linear or switch-mode regulator. The linear regulator exhibits poor efficiency characteristics across its load range. The switch-mode regulator exhibits better efficiency than the linear regulator, but may still suffer from reduced efficiency when it is loaded below a maximum efficiency operating point due to inherent switching and quiescent bias losses within the switch-mode regulator.

The LED system efficacy $E_{SYS}$ refers to the overall illumination efficiency of the LED illumination system 100. Since any energy loss in the LED drive process has to be accounted, the LED system efficacy $E_{SYS}$ is a combination of the driver efficiency $\eta_{DRV}$ and an efficacy $E_{LED}$ of the LEDs in the LED module 104. Hence, the LED system efficacy, the efficacy of the LEDs and the driver efficiency may be respectively represented as $$E_{SYS} = \eta_{DRV} \times E_{LED} = \frac{P_{LED}}{P_{IN}}$$

$$\eta_{DRV} = \frac{P_{OUT}}{P_{IN}}$$

$$E_{LED} = \frac{P_{LED}}{P_{OUT}}$$

wherein $P_{OUT}$ is the output power from the LED driver 102.

FIG. 1B illustrated a diagram 150 indicating two exemplary curves 152 and 154 of the efficacy $E_{LED}$ of the LEDs and the driver efficiency $\eta_{DRV}$ in relevance to the LED current 108. The efficacy $E_{LED}$ of the LEDs and the driver efficiency $\eta_{DRV}$ reach their peak levels $E_{LOPT}$ and $\eta_{DOPT}$ at different LED currents $I_{SMAX}$ and $I_{DMAX}$, respectively. In a typical LED illumination system 100, a preferred LED current $I_{DMAX}$ is determined in between $I_{MIN}$ and a maximum LED current $I_{MAX}$ such that the maximum driver efficiency $\eta_{DOPT}$ is maintained between $I_{MIN}$ and $I_{DMAX}$. Therefore, combined with DC dimming current through the LEDs, the maximum system efficacy $E_{SYS}$ is maximized across the entire dimming range $I_{MIN}$ to $I_{MAX}$.

Various solutions are adopted to drive a dimmable LED illumination system. In one solution, the LED current 108 is generated as a pulse waveform having a frequency, magnitude and duty cycle that are modulated according to a dimming control. The magnitude of the LED current 108 alternates between zero and the maximum LED current $I_{MAX}$ during LED dimming operation. Thus, the LED driver 102 either is disabled or works at a driver efficiency associated with the maximum LED current $I_{MAX}$, and however, the efficacy $\eta_{LED}$ of the LEDs is compromised to work at a relatively low end of the efficacy curve 152 in such a solution. In another solution, the LED current 108 is generated as a direct current (DC) according to the dimming control. Although the LEDs function efficiently under a DC driver current, the LED driver 102 and its driver efficiency $\eta_{DRV}$ is compromised in order to provide such a DC current. Therefore, both solutions cannot reach a preferred overall LED system efficacy upon receiving the varying dimming control.

Although it originates from the dimmable LED illumination system based on a switch-mode regulator, the above efficiency regulation issue commonly exists in a switch-mode regulator or power supply that generates an adjustable average output load current. A need exists to maintain preferred driver efficiency when the switch-mode regulator generates the adjustable average output load current.

SUMMARY OF THE INVENTION

The present invention relates to a switch-mode regulator, and more particularly, to systems, devices and methods of using a switch-mode regulator to regulate an LED current in order to improve overall LED system efficacy and suppress power consumption of a dimmable LED illumination system. Such a switch-mode power supply or regulator may also be used in applications other than the LED illumination system.

In the LED illumination system, a high brightness mode and a moderate brightness mode are implemented. In the high brightness mode, the LED current is larger than a preferred LED current $I_{DMAX}$. In the moderate brightness mode, an output current is substantially equal to the preferred LED current $I_{DMAX}$; upon receiving further dimming control, an LED driver based on the switch-mode regulator operates at a preferred driver efficiency $\eta_{DOPT}$, while the LED current remains as a direct current.

One aspect of the present invention is an LED illumination system that comprises an LED driver, an LED module, a current sink and an output capacitor. The LED driver is coupled to receive a DC power supply and a dimming control, and generates a drive voltage and a current control according to the dimming control. In particular, the LED driver operates in a brightness mode selected from a high brightness mode and a moderate brightness mode. The LED module is coupled to the LED driver and driven by an LED current that is associated with the drive voltage. The current sink is arranged in series with the LED module and limits the LED current to a substantially direct current according to the current control. The output capacitor is coupled in parallel with the LED module and the current sink.

Another aspect of the present invention is an LED driver that comprises a clock generator, a current regulation module, a switching regulator, and a rectifier and filter. The current regulation module receives a dimming control, and generates a current control and a mode control. The switching regulator modulates an AC drive voltage that is generated by the clock generator in a brightness mode selected from a high brightness mode and a moderate brightness mode according to the mode control. The rectifier and filter rectifies and filters the modulated AC drive voltage to generate a drive voltage to drive the LED module. The LED current that is a substantially direct current according to the current control.

Another aspect of the present invention is a method of generating an LED current to drive an LED module in an LED driver. The method comprises the steps of (1) receiving a DC supply voltage and a dimming control, (2) generating a current control according to the dimming control, (3) generating an AC drive voltage, (4) modulating the AC drive signal according to a brightness mode selected from a high brightness mode and a moderate brightness mode, and (5) rectifying and filtering the modulated AC drive voltage to generate an LED current to drive the LED module. The LED current is a substantially direct current according to the current control.

Certain features and advantages of the present invention have been generally described in this summary section; however, additional features, advantages, and embodiments are presented herein or will be apparent to one of ordinary skill in the art in view of the drawings, specification, and claims hereof. Accordingly, it should be understood that the scope of the invention shall not be limited by the particular embodiments disclosed in this summary section.

BRIEF DESCRIPTION OF THE DRAWINGS

Reference will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments.

DETAILED DESCRIPTION OF THE PREFERRED EMBODIMENTS

Figure 1A:
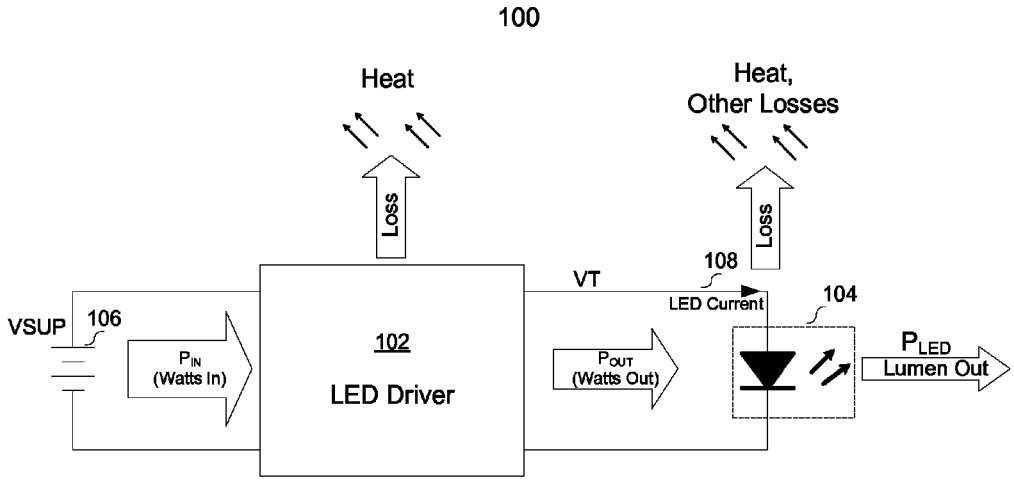
FIG. 1A illustrates a standard LED illumination system and power dissipation in such a system.

In the following description, for purposes of explanation, specific details are set forth in order to provide an understanding of the invention. It will be apparent, however, to one skilled in the art that the invention can be practiced without these details. One skilled in the art will recognize that embodiments of the present invention, described below, may be performed in a variety of ways and using a variety of structures. Those skilled in the art will also recognize additional modifications, applications, and embodiments are within the scope thereof, as are additional fields in which the invention may provide utility. Accordingly, the embodiments described below are illustrative of specific embodiments of the invention and are meant to avoid obscuring the invention.

Reference in the specification to "one embodiment" or "an embodiment" means that a particular feature, structure, characteristic, or function described in connection with the embodiment is included in at least one embodiment of the invention. The appearance of the phrase "in one embodiment," "in an embodiment," or the like in various places in the specification are not necessarily all referring to the same embodiment.

Furthermore, connections between components or between method steps in the figures are not restricted to connections that are effected directly. Instead, connections illustrated in the figures between components or method steps may be modified or otherwise changed through the addition thereto of intermediary components or method steps, without departing from the teachings of the present invention.

Various embodiments of the present invention relates to a switch-mode regulator, and more particularly, to systems, devices and methods of using a switch-mode regulator to regulate an LED current in order to improve overall LED system efficacy and suppress power consumption of a dimmable LED illumination system. One of those skilled in the art knows that such a switch-mode power supply or regulator is not limited to drive LEDs, and may also be used in other applications. Moreover, an LED driver based on the switch-mode regulator may be implemented in a buck, boost or buck-boost topology.

In the moderate brightness mode, operation of the illumination system is based on alternating the LED driver between active and inactive durations, and brightness of the LEDs is adjusted by modulating the width of the active durations according to the dimming control. During each active duration, the LED driver is switched on to provide an output current $I_{OUT}$ equal to the preferred LED current $I_{DMAX}$, and thus, to operate at a preferred driver efficiency $\eta_{DOPT}$. The LEDs are driven to generate illumination at a proper level using part of the output current $I_{OUT}$, and an output capacitor is charged up by the rest of the output current $I_{OUT}$. This proper level of illumination is determined according to the dimming control. During a subsequent inactive duration, the LED driver is switched off, and charge accumulated by the output capacitor is used to provide a supplement current. The supplement current is used as the LED current to drive the LEDs and generate illumination at the proper level.

Generally, excessive power is conserved in each active duration and used to provide illumination power in the subsequent inactive duration. Even though the width of the active durations is adjusted according to the dimming control, the LED current is sustained as a DC current, and the LED driver remains at the preferred driver efficiency $\eta_{DOPT}$. By this means, the overall LED system efficacy may be improved for the dimmable LED illumination system.

Figure 2:
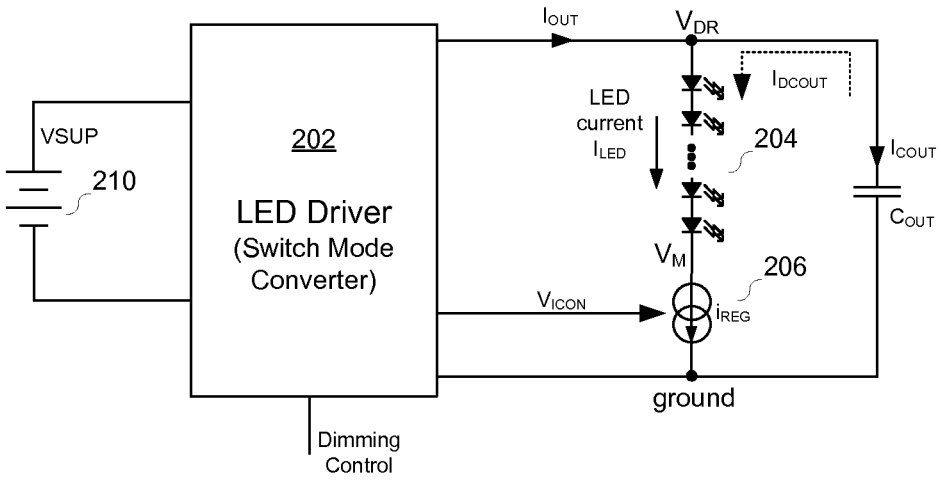
FIG. 2 illustrates an exemplary block diagram of a dimmable LED illumination system according to various embodiments of the invention.

FIG. 2 illustrates an exemplary block diagram 200 of a dimmable LED illumination system according to various embodiments of the invention. The dimmable LED illumination system 200 comprises an LED driver 202, an LED module 204, a current sink 206, and an output capacitor $C_{OUT}$. This dimmable LED illumination system 200 is coupled to a dimming control, and converts the DC supply voltage VSUP to an output current $I_{OUT}$ in accordance with the dimming control. The dimming control is a multiple bit digital signal or an analog signal that is associated with a user input, and used to set a brightness level for the LED module 104. The DC supply voltage VSUP is either provided by a battery or converted from a high voltage AC supply voltage at any wall output. The output current $I_{OUT}$ comprises two currents, an LED current 210 $I_{LED}$ and a charging current $I_{COUT}$.

In one embodiment, the LED driver 202 is based on a switch mode converter that converts a DC voltage to a direct current, i.e., the output current $I_{OUT}$. In a prior art LED illumination system, the switch mode converter includes a continuous AC voltage that has a suitable magnitude, e.g., 3V, and a relatively high frequency, e.g., several MHz. The switching duty cycle and resulting switching current of this continuous AC voltage is adjusted according to the dimming control, such that when this AC voltage is appropriately rectified and smoothed, the LED driver 202 may generate an adjustable DC current to drive the LED module 204. The driver efficiency $\eta_{DOPT}$ of the LED driver 202 may be compromised even though the LED module 204 is driven efficiently using a direct current.

In various embodiments of the inventions, two brightness modes, a high brightness mode and a moderate brightness mode, are incorporated in the LED driver 202. In a high brightness mode, the dimming control requires an LED current that is larger than the preferred LED current $I_{DMAX}$ in FIG. 1B. The conventional approach is applied to modulate the switching duty cycle and switching current of each individual cycle of the continuous AC voltage. Since the LED current $I_{LED}$ exceeds the preferred LED current $I_{DMAX}$, the duty cycle of the continuous AC voltage exceeds its duty cycle at the current $I_{DMAX}$ as well. Thus, the driver efficiency drops from $\eta_{DOPT}$ and is comprised to sustain the high brightness level.

Figure 1B:
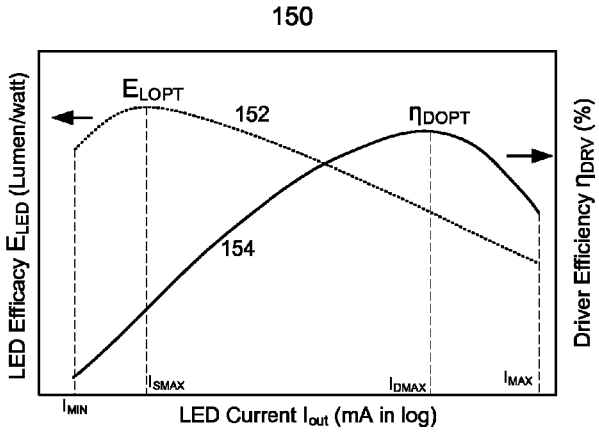
FIG. 1B illustrated a diagram indicating two exemplary curves and of the efficacy $E_{LED}$ of the LEDs and the driver efficiency $\eta_{DRV}$ in relevance to the LED current.

However, in the moderate brightness mode, the dimming control requires an LED current $I_{LED}$ that is smaller than the preferred LED current $I_{DMAX}$ in FIG. 1B. Rather than reducing the duty cycle of the continuous AC voltage, the LED driver 202 sustains the driver efficiency at the preferred efficiency $\eta_{DOPT}$ by enforcing the switching duty cycle and switching current of the continuous AC voltage to those of a preferred AC voltage associated with the preferred LED current $I_{DMAX}$. This continuous AC voltage is enabled and disabled periodically during active and inactive durations, respectively. Excessive illumination power is accumulated within the active durations, and used within the inactive durations.

In such a moderate brightness mode, the continuous AC signal is modulated with a duration control signal $V_{IC}$ that determines the periodic active and inactive durations. The modulated AC driver voltage is enabled during active durations, and disabled during inactive durations. During the active durations, the magnitude, frequency, switching duty cycle and switching current of the AC drive voltage are determined, such that the LED driver 202 operates at the preferred driver efficiency $\eta_{DOPT}$. The modulated AC drive voltage is rectified and smoothed to generate a drive voltage $V_{DR}$ and an output current $I_{OUT}$. The output current $I_{OUT}$ is associated with the preferred LED current $I_{DMAX}$. During the inactive durations, the LED driver 202 is disabled, and thus, consumes no power. As a result, the LED driver 202 periodically switches between the active and inactive durations, and may sustain its preferred driver efficiency $\eta_{DOPT}$ once it is enabled.

The current sink 206 is coupled in series with the LED module 204 between the drive voltage $V_{DR}$ and the ground, while the output capacitor $C_{OUT}$ is biased in parallel between $V_{DR}$ and the ground. The current sink 206 is coupled to receive a current control signal $V_{ICON}$ from the LED driver 202. This current control signal $V_{ICON}$ may be either a multiple bit digital signal or an analog voltage for a current sink 206 that is implemented in a digital or analog configuration. During the active durations, the output current $I_{OUT}$ splits to an LED current $I_{LED}$ and a charging current $I_{COUT}$ which are used to drive the LED module 204 and charge the output capacitor $C_{OUT}$, respectively. During the inactive durations, the output current $I_{OUT}$ generated by the LED driver 202 is disabled, and a supplement current $I_{DCOUT}$ is provided by the output capacitor $C_{OUT}$ to drive the LED module 204. Regardless of the active or inactive durations, the current control signal $V_{ICON}$ controls the current sink 206 to limit the LED current $I_{LED}$ to a value determined by the dimming control.

Figure 3A:
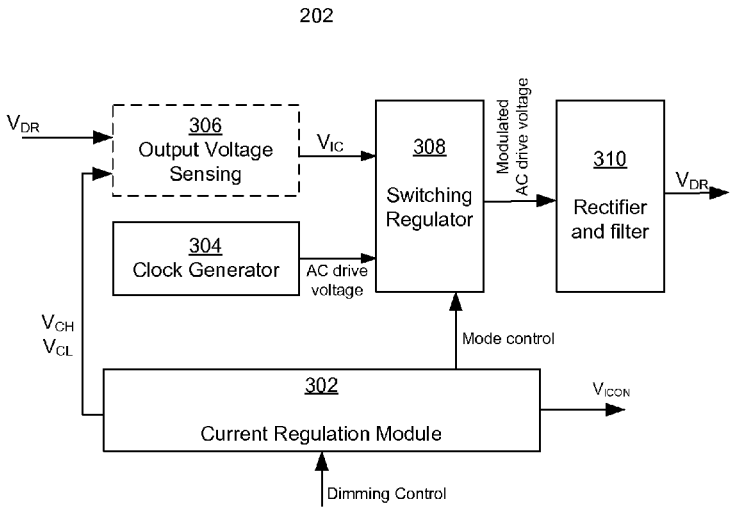
FIG. 3A illustrates an exemplary block diagram of the LED driver that is based on a switch mode converter according to various embodiments of the invention.

FIG. 3A illustrates an exemplary block diagram of the LED driver 202 that is based on a switch mode converter according to various embodiments of the invention. This LED driver 202 selects a brightness mode, determines critical voltages $V_{CH}$ and $V_{CL}$, and generates the drive voltage $V_{DR}$ and the output current $I_{OUT}$. In accordance with the dimming control, the drive voltage $V_{DR}$ is controlled within an output range that is determined by the voltages $V_{CH}$ and $V_{CL}$. The upper and lower limits of the output range are equal to the high and low critical voltages $V_{CH}$ and $V_{CL}$, respectively. To properly drive the LED module 204, the low critical voltage $V_{CL}$ is determined according to the lowest conduction voltage of the LED module 204. To implement the above functions, the LED driver 202 comprises a current regulation module 302, a clock generator 304, an output voltage sensing circuit 306, a switching regulator 308, and a rectifier and filter 310.

Figures 3B, 3C:
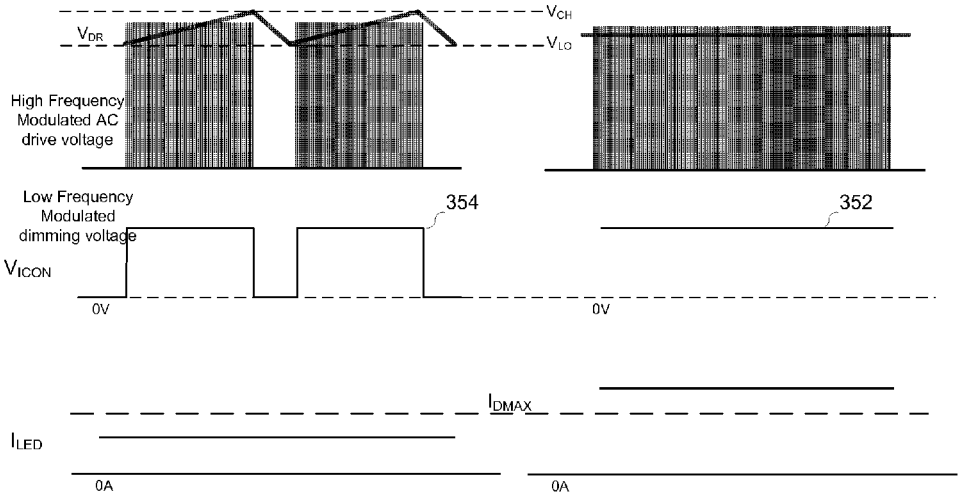
FIG. 3B and 3C illustrates two exemplary sets of signals that are respectively associated with a moderate brightness mode and a high brightness mode in the LED driver 202 according to various embodiments of the invention.

FIGS. 3B and 3C illustrates two exemplary sets of signals that are respectively associated with a moderate brightness mode and a high brightness mode in the LED driver 202 according to various embodiments of the invention. In the high brightness mode, the LED current $I_{LED}$ is beyond the preferred LED current $I_{DMAX}$, and no modulation of active durations is applied. However, the duty cycle of each individual cycle is modulated for the continuous AC drive voltage to enhance the LED current beyond $I_{DMAX}$. In the moderate brightness mode, the LED current $I_{LED}$ is below the preferred LED current $I_{DMAX}$, and modulation of active durations is applied using a duration control $V_{IC}$. The drive voltage is controlled within the output range determined between $V_{CH}$ and $V_{CL}$.

This continuous AC drive voltage is a continuous periodic sinusoidal or square wave signal that has a high frequency around several MHz. The clock generator 304 is used to generate this AC drive voltage. In one embodiment, the magnitude is set at the level of the supply voltage VSUP, the frequency and the duty cycle are randomly selected at several MHz and 50%, respectively. The resulting LED current is less than the maximum LED current $I_{MAX}$. In particular, the magnitude, frequency and switching duty cycle and switching current are adjusted to result in the preferred LED current $I_{DMAX}$.

The current regulation module 302 is coupled to receive the dimming control; and determines the current control signal $V_{ICON}$, a mode control signal, and the critical voltages $V_{CH}$ and $V_{CL}$. The current control signal $V_{ICON}$ is associated with the dimming control, and applied to limit the LED current $I_{LED}$ in the LED module 204. The current regulation module 302 may further comprise a memory which is applied to store the value of a preferred dimming control associated with the preferred LED current $I_{DMAX}$, such that an incoming diming control can be compared to the value to determine the brightness mode.

The mode control signal is generated according to the brightness mode. When the dimming control is associated with an LED current $I_{LED}$ that is equal to or less than the preferred LED current $I_{DMAX}$, the mode control signal is set to enable the moderate brightness mode in the switching regulator 308. In accordance with the dimming control, the critical voltages $V_{CH}$ and $V_{CL}$ are provided to the output voltage sensing circuit 306 Likewise, when the dimming control is associated with an LED current $I_{LED}$ that is higher than the preferred LED current $I_{DMAX}$, the mode control signal is set to enable the high brightness mode in the switching regulator 308, and however, the critical voltages $V_{CH}$ and $V_{CL}$ are not needed in this mode. Therefore, the current regulation module 302 functions as a local core for the driver to determine the brightness mode and provide reference voltages, i.e., $V_{CH}$ and $V_{CL}$.

The output voltage sensing circuit 306 is coupled to receive the drive voltages $V_{DR}$ and the critical voltages $V_{CH}$ and $V_{CL}$, and generates the duration control $V_{IC}$ that is used to determine the active and inactive durations of the AC drive voltage. In the high brightness mode, no duration control is needed. The output voltage sensing module 306 is either disabled or outputs a high logic 352. In the moderate brightness mode, the drive voltage $V_{DR}$ is compared to both of the critical voltages $V_{CH}$ and $V_{CL}$. In accordance with curve 354, the duration control $V_{IC}$ is enabled when the drive voltage $V_{IC}$ increases from the low critical voltage $V_{CL}$ to the high critical voltage $V_{CH}$, and disabled when the drive voltage $V_{IC}$ drops from $V_{CH}$ to $V_{CL}$. The period and duty cycle of this duration control $V_{IC}$ may vary with the brightness level as determined by the dimming control, and its frequency is much smaller than the frequency of the AC drive voltage.

The switching regulator 308 is coupled to the current regulation module 302, the clock generator 304, and the output voltage sensing circuit 306. The switching regulator 308 functions at both brightness modes, i.e., the high or moderate brightness modes, and the AC drive voltage is modulated in two corresponding manners. The modulated AC drive voltage is further rectified and smoothed by the rectifier and filter 310 to provide the DC drive voltage $V_{DR}$ and the DC output current $I_{OUT}$.

In the high brightness mode, the switching regulator 308 is used to modulate the switching duty cycle of each cycle within the AC drive voltage. In various embodiments of the invention, the higher brightness level is associated with a larger duty cycle. When the duty cycle is increased to a maximum value, the LED current $I_{LED}$ reaches its maximum current $I_{MAX}$ and the LED module 204 shows its highest brightness level. Apparently, in the high brightness mode, both the driver efficiency $\eta_{DRV}$ and the efficacy $E_{LED}$ of the LED module 204 drop as the LED current $I_{LED}$ increases up.

Such duty cycle modulation in the high brightness mode is employed in most of the prior art dimmable LED illumination systems that are based on DC dimming. In the prior art systems, such modulation is applied within the entire illumination range. In particular, when the LED current $I_{LED}$ is less than the preferred LED current $I_{LED}$, the driver efficiency $\eta_{DRV}$ is compromised to ensure the efficacy $E_{LED}$ of the LED module 204.

In various embodiments of the invention, the duration control $V_{IC}$ used in the moderate brightness mode to control the active and inactive durations has a relatively lower frequency than that of the AC drive voltage. In each active duration, the modulated AC drive voltage is generated to maintain the magnitude, frequency and duty cycle that are associated with the preferred LED current $I_{DMAX}$; in each inactive duration, the modulated AC drive voltage is disabled. In some embodiments, the AC drive voltage is predetermined according to the preferred LED current $I_{DMAX}$, and therefore, modulation of active durations is sufficient to generate the modulated AC drive voltage. In some embodiments, the AC drive voltage is predetermined according to the maximum LED current $I_{MAX}$. In addition to modulation of the active durations, an alternative modulation is needed on each cycle of the AC drive voltage to tune down the output current $I_{OUT}$ from the maximum LED current $I_{MAX}$ to the preferred LED current $I_{DMAX}$ during the active durations. Regardless of the modulations, a substantially constant output current $I_{OUT}$ may be generated at the level of the preferred LED current $I_{DMAX}$ during the active durations in the moderate brightness mode. In accordance, a substantially direct current is delivered to drive the LED module 204, while the LED driver 202 sustains its preferred driver efficiency $\eta_{DOPT}$ by preferably operating in the active durations.

Figure 4:
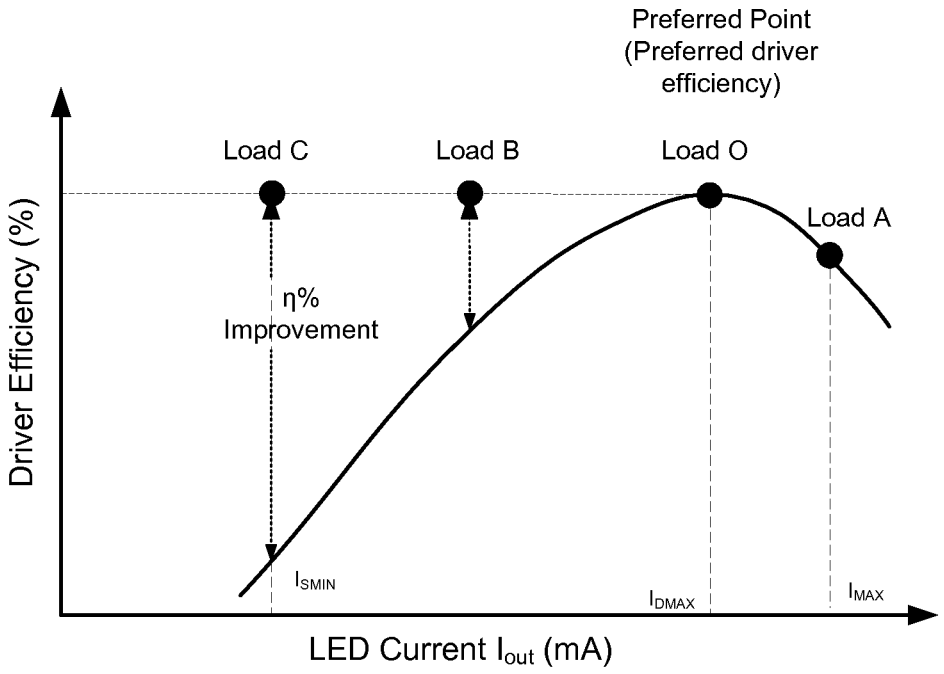
FIG. 4 illustrates an exemplary relationship between the driver efficiency and the LED current $I_{LED}$ according to various embodiments in the invention.
Figure 5A:
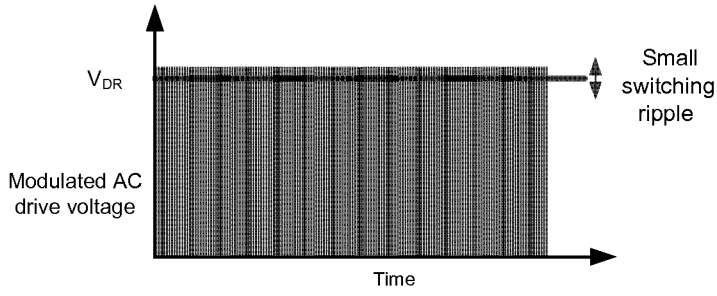
FIGS. 5A-5C illustrate three exemplary diagrams for the modulated AC drive voltage and the drive voltage $V_{DR}$ under load conditions A, B and C according to various embodiments in the invention.
Figure 5B:
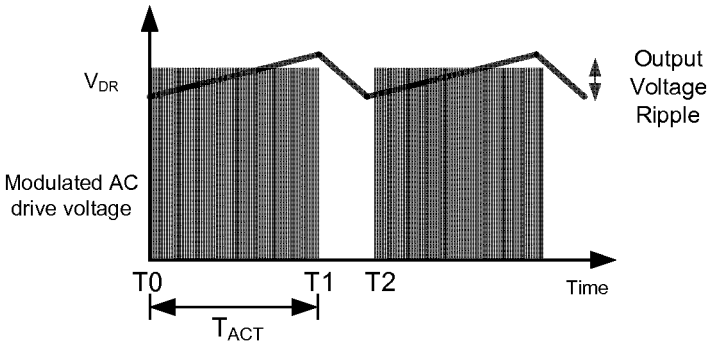
Figure 5C:
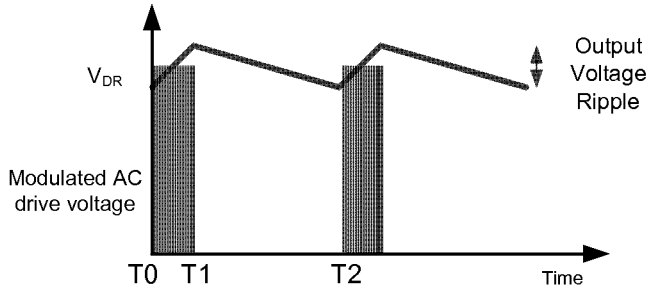

FIG. 4 illustrates an exemplary relationship 400 between the driver efficiency and the LED current $I_{LED}$ according to various embodiments in the invention. The load conditions A, B and C are associated with three descending brightness levels determined by the dimming control. FIGS. 5A-5C illustrate three exemplary diagrams for the modulated AC drive voltage and the drive voltage $V_{DR}$ under load conditions A, B and C according to various embodiments in the invention.

Load condition A is associated with the high brightness mode in which relatively high brightness is provided by the LED module 204. The resulting LED current $I_{LED}$ is $I_{MAX}$, which is larger than the preferred LED current $I_{DMAX}$. The AC drive voltage is modulated at the level of each high frequency cycle. No active duration modulation is involved. In some embodiments, it may also be regarded that the active duration is maximized such that adjacent active durations merge with each other. The drive voltage $V_{DR}$ is stabilized at a substantially constant voltage. In general, both the duty cycle of the AC drive voltage and the level of the drive voltage $V_{DR}$ increase as the brightness level increases.

Load condition O is associated with a preferred driver efficiency $\eta_{DOPT}$ that occurs when the LED current reaches the preferred LED current $I_{DMAX}$. The switching duty cycle is not modulated for each high frequency cycle, but is set at a fixed duty cycle according to the preferred driver efficiency μ efficiency $\eta_{DOPT}$.

Load condition B is associated with the moderate brightness mode that is based on the preferred switch-mode efficiency obtained at $I_{DMAX}$. The LED module 204 provides moderate brightness as determined by the dimming control. In one embodiment, the drive voltage $V_{DR}$ is controlled between the high critical voltage $V_{CH}$ and the low critical voltage $V_{CL}$. Once the LED current is less than $I_{DMAX}$ between load conditions O and C, modulation of active duration is enabled to control the preferred AC drive voltage and switching currents. The modulated AC drive voltage adopts the magnitude, frequency, duty cycle and switching currents of a preferred AC drive voltage. The preferred AC drive voltage and switching currents are associated with the preferred LED current $I_{DMAX}$. Although the instantaneous output current $I_{OUT}$ is equal to the preferred LED current $I_{DMAX}$, the LED current $I_{LED}$ is limited by the current sink 206 according to the dimming control. An excessive current is directed to charge the output capacitor, and the drive voltage $V_{DR}$ increases.

As illustrated in FIG. 5B, once $V_{DR}$ reaches the high critical voltage $V_{CH}$ at time T1, the output voltage sensing circuit 304 disables the duration control $V_{IC}$ to terminate the active duration and start an inactive duration. In this inactive duration, the modulated AC drive voltage is disabled. Therefore, during times T1 to T2, the drive voltage $V_{DR}$ is sustained by the output capacitor $C_{OUT}$, and gradually drops via discharging through the LED module 204 at the LED current $I_{LED}$ as determined by the current sink 206. Once $V_{DR}$ drops to the low critical voltage $V_{CL}$, the output voltage sensing circuit 304 enables the duration control $V_{IC}$, and the current regulation module 306 is enabled again to drive the LED module 204 to a subsequent active duration. Therefore, upon monitoring the drive voltage $V_{DR}$, the LED driver 202 may drive the LED module 204 in a periodic manner. As illustrated in FIG. 5B, a period for the active and inactive durations is equal to T2–T0, and the width of the active duration is T1–T0, i.e., $T_{ACT}$.

As illustrated in FIG. 5C, load condition C is also associated with the moderate brightness mode in which, however, lower brightness than that in load condition B is provided by the LED module 204. In one embodiment, the drive voltage $V_{DR}$ is also controlled between a high critical voltage $V_{CH}$ and a low critical voltage $V_{CL}$. Since the lower brightness level is associated with a smaller LED current $I_{LED}$, a larger amount of excessive current in $I_{DMAX}$ is spared to charge the output capacitor $C_{OUT}$. The drive voltage $V_{DR}$ rises up and reaches the high critical voltage $V_{CH}$ at a faster rate in the active duration (time T0-T1), and also due to the smaller LED current $I_{LED}$, the voltage $V_{DR}$ drops at a slower rate in the inactive duration (time T1-T2). Compared to load condition B, the width of the active duration T1-T0 ($T_{ACT}$) is reduced, and so is brightness of the LED module 204 reduced in load condition C.

For load conditions B and C in the moderate brightness mode, the drive voltage $V_{DR}$ is controlled to oscillate between a high critical voltage $V_{CH}$ and a low critical voltage $V_{CL}$. In certain embodiment, the critical voltages $V_{CH}$ and $V_{CL}$ are determined according to brightness requirement set by the dimming control in the current regulation module 302. A higher brightness level is associated with larger critical voltages $V_{CH}$ and $V_{CL}$. However, in a preferred embodiment, the critical voltages $V_{CH}$ and $V_{CL}$ are fixed regardless of the dimming control, and both of them are less than a preferred drive voltage in association with the preferred LED current $I_{DMAX}$.

Both the width and the period of the active durations are determined by the difference of $V_{CH}$ and $V_{CL}$, and in particular, a larger difference of $V_{CH}$ and $V_{CL}$ are associated with a larger width and a longer period for the active durations. Once $_{VCH}$ and $V_{CL}$ are fixed, various load conditions, e.g., B and C, may slightly impact the period, and however, causes a significant variation to the width of the active durations.

In certain embodiments, the current regulation module 306 directly determines the period and width of the active durations according to the dimming control. In the moderate brightness mode, the period of the active durations may be fixed, while the width $T_{ACT}$ is extended longer for high brightness, e.g., load condition B, than low brightness, e.g., load condition C. A similar oscillation may also be observed for the drive voltage $V_{DR}$. In this embodiment, the current regulation module 302 generates the duration control $V_{IC}$ directly from the dimming control, and provides it to the switching regulator 308; and thus, the drive voltage $V_{DR}$ may not be monitored.

Regardless of the load condition, the preferred driver efficiency $\eta_{DOPT}$ is maintained in the moderate brightness mode in the dimmable LED illumination system 200. During the active duration, i.e., between times T0-T1, the modulated AC drive voltage and switching currents are enabled, and the LED module 204 and the output capacitor $C_{OUT}$ are driven with a preferred LED current $I_{DMAX}$. The preferred driver efficiency $\eta_{DOPT}$ is maintained in the active durations. Thereafter, during the inactive duration, the modulated AC drive voltage is disabled. Rather, the output capacitor $C_{OUT}$ discharges its accumulated charges to drive the LED module 204 at an LED current $I_{LED}$ as determined by the current control $I_{ICON}$. By this means, illumination power collected during the active duration is spread evenly to the entire period to provide a desired brightness level as specified by the dimming control. The preferred driver efficiency $\eta_{DOPT}$ is maintained, while the LED module 204 is driven by a direct current to sustain a desired system efficacy.

Although the voltage $V_{DR}$ fluctuates between the critical voltages $V_{CH}$ and $V_{CL}$, the LED current $I_{LED}$ is preferably a direct current to avoid flickering of the LEDs in the LED module 204 and to maintain the preferred LED efficacy in the LED module 204. The current sink 206 enforces a substantially constant LED current and thus eliminates most of the noises including output voltage ripples caused by the $V_{CH}$ to $V_{CL}$ deviation. The rectification and filter unit 208 is capable of attenuating high frequency ripple in the voltage $V_{DR}$, and avoids its coupling to the LED current $I_{LED}$. Even if a variation exists in the LED current $I_{LED}$ due to modulations of active/inactive durations, an associated brightness variation may be naturally averaged by our eyes. As far as the period of such variation is controlled within one sampling/integration period of human eyes, this brightness variation may not be noticed by our visual systems, while the absolute brightness level is substantially constant as determined by the dimming control. In various embodiments of the invention, the frequency for the active and inactive durations is maintained above an audible noise threshold, i.e., 20 kHz. As a result, oscillation in the drive voltage $V_{DR}$ may not lead to noticeable visual artifacts in illumination.

Figure 6A:
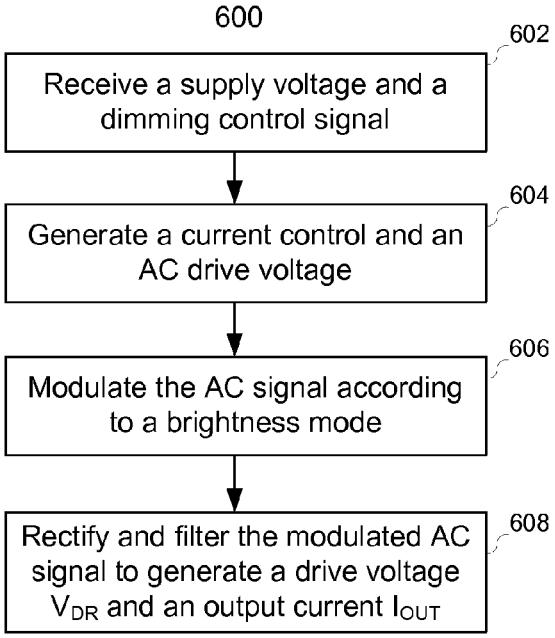
FIG. 6A illustrates an exemplary flow chart of a method used to drive a dimmable LED illumination system according to various embodiments in the invention.

FIG. 6A illustrates an exemplary flow chart 600 of a method used to drive a dimmable LED illumination system according to various embodiments in the invention. At step 602, the LED illumination system receives a DC supply voltage VSUP, and a dimming control signal. The dimming control signal determines brightness, i.e., illumination power, of an LED module included in the LED illumination system. At step 604, a current control is generated based on the dimming control signal, and an AC drive voltage or a clock signal is generated and level shifted to drive a switching regulator. In one embodiment, the magnitude, frequency and duty cycle of the AC drive voltage are determined such that such an AC signal may be regulated to generate a preferred LED current $I_{DMAX}$; and accordingly, the LED module may be driven at a direct current based on a preferred driver efficiency $\eta_{DOPT}$ associated with $I_{DMAX}$. At step 606, the AC drive voltage is modulated according to a brightness mode. At step 608, the modulated AC drive voltage is rectified and filtered to generate a drive voltage $V_{DR}$ and an output current $I_{OUT}$ that drive the LED module and an output capacitor $C_{OUT}$. In certain embodiment, the LED current $I_{LED}$ in the LED module is controlled by a serial current sink according to the current control.

Figure 6B:
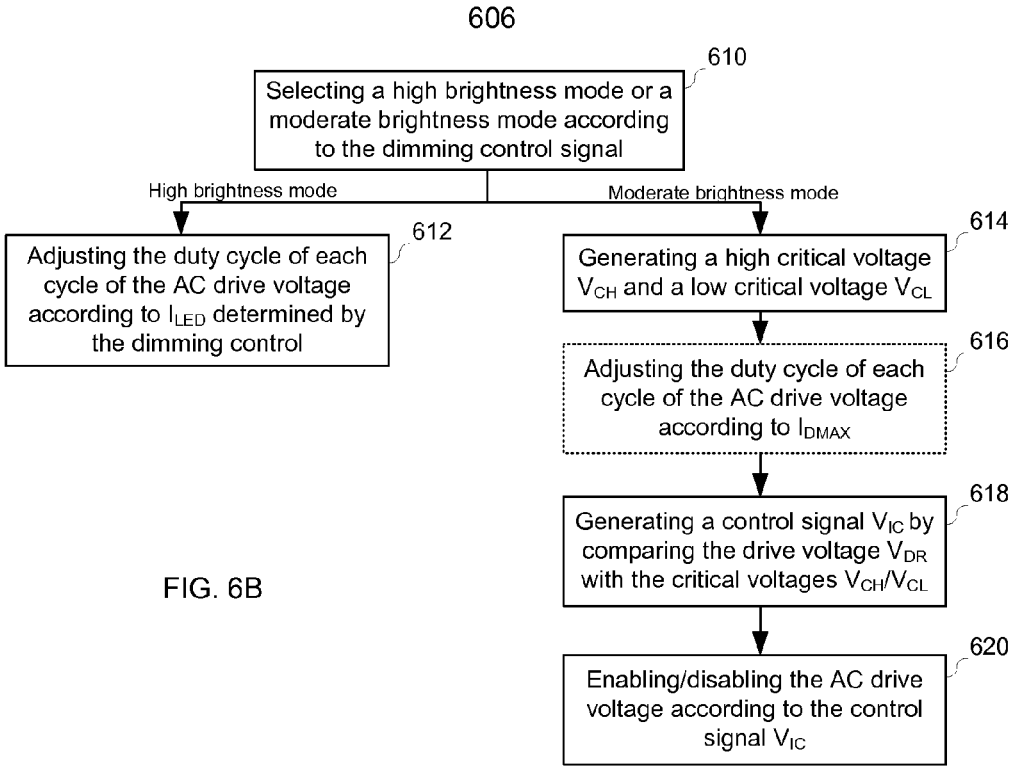
FIG. 6B illustrates an exemplary method of modulating the AC drive voltage according to various embodiments in the invention.

FIG. 6B illustrates an exemplary method 606 of modulating the AC drive voltage according to various embodiments in the invention. At step 610, a brightness mode is selected between a high brightness mode and a moderate brightness mode according to the dimming control. In the high brightness mode, the LED current needs to be larger than the preferred LED current $I_{DMAX}$, and thus, the switching duty cycle and switching current of each cycle in the AC drive voltage is adjusted according to $I_{LED}$ at step 612.

In the moderate brightness mode, the LED current needs to be smaller than the preferred LED current $I_{DMAX}$. The moderate brightness mode is associated with alternating active and inactive durations. The LED driver maintains the preferred driver efficiency during the active duration, and the output capacitor provides a supplemental current as the LED current during the inactive duration. A high critical voltage $V_{CH}$ and a low critical voltage $V_{CL}$ are generated at step 614. If the AC drive voltage is not associated with the preferred LED current $I_{DMAX}$, then the duty cycle of each cycle in the AC drive voltage is adjusted such that the preferred LED current $I_{DMAX}$ is generated when no dimming control is applied at step 616. However, if the AC drive voltage is already associated with the preferred LED current $I_{DMAX}$ at step 614, step 616 is optional; and the drive voltage $V_{DR}$ is directly monitored, and used to generate a control signal $V_{IC}$ according to the critical voltages $V_{CH}$ and $V_{CL}$ at step 618. The control signal $V_{IC}$ determines active and inactive durations. At step 620, the AC drive voltage is disabled or enabled according to the control signal $V_{IC}$, and thereafter, converted to the modulated AC drive voltage.

In another embodiment, the dimming control signal is applied to determine an active duration width $T_{ACT}$ and a period $T_{LED}$ for LED current control, rather than $V_{CH}$ and $V_{CL}$, at step 614. At step 618, the control signal $V_{IC}$ is thus generated according to the active duty duration width $T_{ACT}$ and period $T_{LED}$.

One of those skilled in the art will recognize that the method 600 can be applied to address the efficiency regulation issue commonly existing in a switch-mode regulator or power supply that generates an adjustable average current. The switch-mode regulator drives a load that relies on the regulator to provide a load current, i.e., the adjustable average current. The efficiency of the switch-mode regulator reaches a preferred driver efficiency $\eta_{ODRV}$ at a preferred load current $I_{DMAX}$, if modulation is applied on a duty cycle level within the regulator. In accordance with the high and moderate brightness modes, two current control modes are used in the regulator, and are differentiated by the preferred load current in this switch-mode regulator. Particularly, in a moderate current control mode, active and inactive durations are alternated in the switch-mode regulator to avoid modulation on the duty cycle level, such that the preferred efficiency is maintained.

It will be appreciated to those skilled in the art that the preceding examples and embodiments are exemplary and are for the purposes of clarity and understanding and not limiting to the scope of the present invention. It is intended that all permutations, enhancements, equivalents, combinations, and improvements thereto that are apparent to those skilled in the art upon a reading of the specification and a study of the drawings are included within the true spirit and scope of the present invention. It is, therefore, intended that the claims in the future non-provisional application will include all such modifications, permutation and equivalents as fall within the true spirit and scope of the present invention.

What is claimed is:

1. A dimmable light emitting diode (LED) illumination system, comprising:

a LED driver coupled to receive a DC power supply and a dimming control, the LED driver operates at a plurality of brightness modes and generates a drive voltage and a current control according to the dimming control, the LED driver operates in an active duration mode and an inactive duration mode;

a current sink coupled to receive the current control, the current sink controls an LED current through an LED to a substantially direct current during an active duration and an inactive duration;

an output capacitor, coupled to receive the drive voltage, the output capacitor provides a supplemental current to the LED during the inactive duration; and wherein when the LED driver alternates between the active duration mode and the inactive duration mode, the LED driver is operating in a first mode that is associated with moderate brightness modes within plurality of brightness modes, and wherein when the LED driver operates only in the active mode, the LED drive is operating in a second mode that is associated with high brightness modes within the plurality of brightness modes, wherein in the first mode, the LED current is smaller than a maximum driver efficiency LED current, and wherein in the second mode, the LED current is larger than the maximum driver efficiency LED current.

2. The dimmable LED illumination system in claim 1, wherein in the first mode, during each active duration, an output current generated by the LED driver is split to the LED current and a charging current that charges the output capacitor, such that the output current is disabled during the inactive duration, and charges accumulated on the output capacitor in the active duration are discharged to provide the supplemental current as the LED current.

3. The dimmable LED illumination system in claim 1, wherein in the first mode, a high critical voltage and a low critical voltage are generated, and a driver voltage is controlled between the high and low critical voltages to enable and disable the active and inactive durations for the LED driver.

4. The dimmable LED illumination system in claim 1, wherein in the first mode, a width of the active durations is associated with a brightness level in the LED.

5. The dimmable LED illumination system in claim 1, wherein in the second mode, the LED driver remains in the active duration in which duty cycle of each high frequency cycle in an AC drive voltage is modulated according to the dimming control.

6. The dimmable LED illumination system in claim 1, wherein the LED driver is based on a switch mode converter.

7. The dimmable LED illumination system in claim 1, wherein the LED driver further comprises:

a clock generator, the clock generator generates an AC drive voltage;

a current regulation module coupled to receive the dimming control, the current regulation module generates the current control, a first critical voltage and a second critical voltage, the first critical voltage being smaller than the second critical voltage;

an output voltage sensing circuit coupled to the current regulation module, the output voltage sensing circuit compares the drive voltage to the first and second critical voltages, and generates a duration control that determines the active and inactive durations;

a switching regulator coupled to the clock generator, the current regulation module and the output voltage sensing circuit, the switching regulator modulates the AC drive voltage according to the mode control and the duration control; and a rectifier and filter coupled to the switching regulator, the rectifier and filter rectifies and filters modulated AC signal to generate the drive voltage.

8. The dimmable LED illumination system in claim 7, wherein the AC drive voltage has a magnitude, frequency and duty cycle that are associated with a current selected from a maximum LED current and the maximum driver efficiency LED current, and the maximum driver efficiency LED current is associated with the a preferred driver efficiency in the LED.

9. A light emitting diode (LED) driver that generates an LED current to drive an LED according to a dimming control, comprises:

a clock generator, the clock generator generates an AC drive voltage;

a current regulation module coupled to receive a dimming control, the current regulation module generates a current control and a mode control;

a switching regulator coupled to the clock generator and the current regulation module, the switching regulator modulates the AC drive voltage in a brightness mode selected from a plurality of brightness modes according to the mode control;

a rectifier and filter coupled to the switching regulator, the rectifier and filter rectifies and filters the modulated AC drive voltage to generate a drive voltage to drive the LED, the drive voltage being associated with the LED current that is a substantially direct current according to the current control; and wherein when the LED driver alternates between the active duration mode and the inactive duration mode, the LED driver is operating in a first mode that is associated with moderate brightness modes within plurality of brightness modes, and wherein when the LED driver operates only in the active mode, the LED drive is operating in a second mode that is associated with high brightness modes within the plurality of brightness modes, wherein in the first mode, the LED current is smaller than a maximum driver efficiency LED current, and wherein in the second mode, the LED current is larger than the maximum driver efficiency LED current.

10. The LED driver in claim 9, wherein a current sink is coupled to receive the current control, and controls the LED current through the LED to a substantially direct current during the active and inactive durations.

11. The LED driver in claim 9 wherein in the second mode, the LED driver remains in the active duration mode in which duty cycle of each cycle in the AC drive voltage is modulated according to a brightness level in the LED.

12. The LED driver in claim 9, wherein during a moderate brightness mode, an output capacitor accumulates charges during the active duration and provides a supplemental current to the LED during the inactive duration.

13. The LED driver in claim 9, further comprising:

an output voltage sensing circuit coupled to the current regulation module, the output voltage sensing circuit compares the drive voltage to a first critical voltage and a second critical voltage that are provided by the current regulation module, and generates a duration control that determines the active and inactive durations.

14. The LED driver in claim 9, wherein the AC drive voltage has a magnitude, frequency and duty cycle that are associated with a current selected from a maximum LED current and the maximum driver efficiency LED current, and the maximum driver efficiency LED current is associated with the a preferred driver efficiency in the LED.

15. The method of generating a load current to drive a load in a driver, comprising the steps of:

(1) receiving a DC supply voltage and a dimming control;

(2) generating a current control according to the dimming control;

(3) generating and modulating an AC drive signal according to a plurality of brightness modes;

(4) rectifying and filtering the modulated AC drive voltage to generate the load current to drive the load, the load current being controlled to a substantially direct current according to the current control during an active duration and an inactive duration; and wherein when the LED driver alternates between the active duration mode and the inactive duration mode, the LED driver is operating in a first mode that is associated with moderate brightness modes within plurality of brightness modes, and wherein when the LED driver operates only in the active mode, the LED drive is operating in a second mode that is associated with high brightness modes within the plurality of brightness modes, wherein in the first mode, the LED current is smaller than a maximum driver efficiency LED current, and wherein in the second mode, the LED current is larger than the maximum driver efficiency LED current.

16. The method in claim 15, wherein the load is an LED, and the method is used to generate the load current as an LED current to drive the LED.

17. The method in claim 16, wherein the step of generating and modulating the AC drive signal further comprises the steps of:

(1) selecting a second mode from plurality of current control modes, wherein the second mode is associated with a high brightness mode, and no inactive duration is involved; and (2) adjusting duty cycle of each individual cycle of the AC drive voltage according to the dimming control.

18. The method in claim 16, wherein the first mode is a moderate brightness mode, and the step of modulating the AC drive signal further comprises the steps of:

(1) selecting the first mode from plurality of current control modes;

(2) generating a first critical voltage and a second critical voltage, the first critical voltage being smaller than the second critical voltage which is further less than a maximum driver efficiency drive voltage associated with the maximum driver efficiency LED current;

(3) adjusting duty cycle of each individual cycle of the AC drive voltage to associate with the maximum driver efficiency LED current;

(4) generating a duration control by comparing the drive voltage with the first and second critical voltages to determine the active and inactive durations; and (5) enabling and disabling the AC drive voltage during active and inactive durations.

19. The method in claim 16, wherein the first mode is a moderate brightness level in which width of active durations is adjusted according to a brightness level in the LED based on the dimming control.

20. The method in claim 16, wherein a current sink used to control the LED current to the substantially direct current according to the current control.

* * * * *